United States Patent [19]

Ellison et al.

[11] Patent Number: 4,717,008

[45] Date of Patent: Jan. 5, 1988

[54] AUTOMATIC COIN FEEDER WITH WINDING MECHANISM

[75] Inventors: Frank M. Ellison, 1376 Nottingham Rd., Charleston, W. Va. 25314; Hasan T. Gencsoy; Nelson S. Smith, Jr., both of Morgantown, W. Va.

[73] Assignee: Frank M. Ellison, Charleston, W. Va.

[21] Appl. No.: 710,440

[22] Filed: Mar. 11, 1985

[51] Int. Cl.[4] ..... G07F 17/24

[52] U.S. Cl. ..... 194/343; 194/228; 194/234

[58] Field of Search ..... 194/342, 343, 234, 238, 194/227, 228; 133/5 R, 5 A; 221/14

[56] References Cited

U.S. PATENT DOCUMENTS

| | | | |
|---|---|---|---|
| 2,206,983 | 7/1940 | Troy, Jr. | 221/15 |
| 2,310,089 | 2/1943 | Hudson | 194/219 |
| 2,429,478 | 10/1947 | Michaels | 194/227 X |
| 2,551,493 | 5/1951 | Jenks | 133/5 R |
| 2,603,288 | 7/1952 | Sollenberger | 194/227 X |
| 2,624,351 | 1/1953 | Smith et al. | 133/5 R |
| 2,769,517 | 11/1956 | Hudson | 194/246 |
| 2,893,596 | 7/1959 | Gabrielsen | 221/14 X |
| 2,941,536 | 6/1960 | Doubleday | 133/5 R |
| 2,953,280 | 10/1960 | Scarboro | 221/15 |
| 3,138,165 | 6/1964 | Erickson et al. | 133/5 R |
| 3,194,249 | 7/1965 | Lonke et al. | 133/4 R |
| 3,369,697 | 2/1968 | Gluckman et al. | 221/9 |
| 3,593,881 | 7/1971 | Peap | 221/3 |
| 3,722,742 | 3/1973 | Wertz | 221/15 |
| 4,257,436 | 3/1981 | Smith | 133/5 R |

FOREIGN PATENT DOCUMENTS 2405522 5/1979 France .

*Primary Examiner*—Robert J. Spar
*Assistant Examiner*—Jay I. Alexander
*Attorney, Agent, or Firm*—Hall, Myers & Rose

[57] ABSTRACT

Apparatus automatically feeds coins into a parking meter. The timing clock used in the parking meter operates an external coin feeding mechanism to feed a coin when the time on the parking meter is about to expire. The invention is applicable to parking meters of the type wherein the insertion of the coin rewinds the clock as well as of the type wherein a knob is turned to rewind the clock after the coin is inserted. With the latter form of parking meter a special battery powered circuit is employed to wind the clock in increments after a coin has been automatically inserted.

19 Claims, 21 Drawing Figures

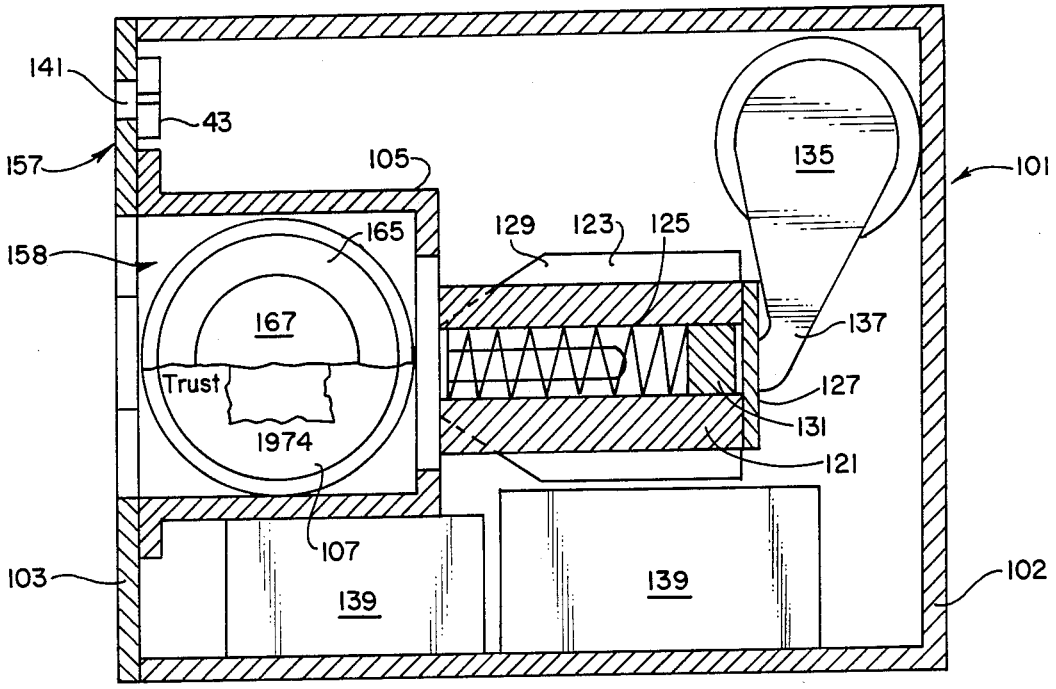
FIG. 11
FIG. 12
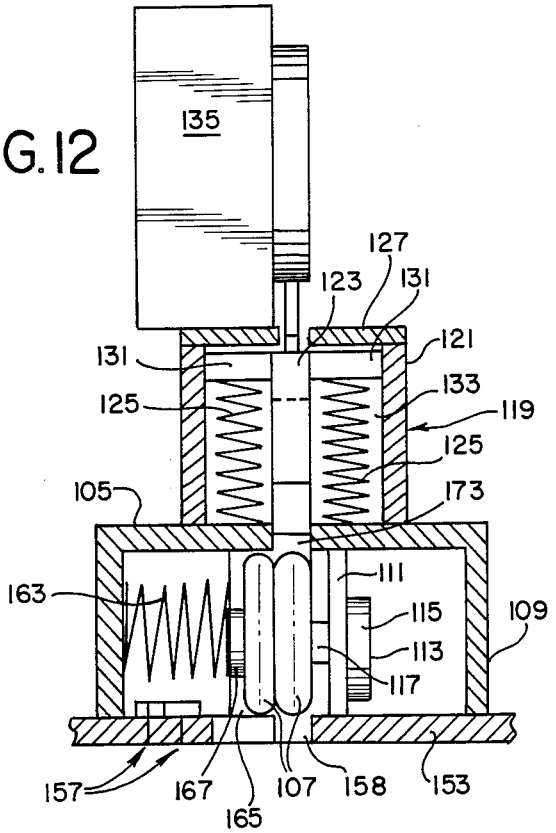
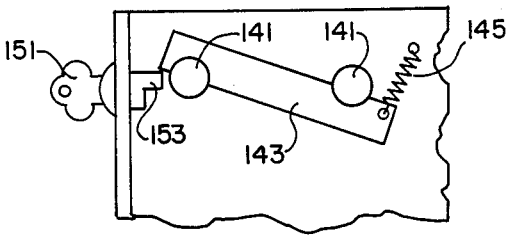
FIG. 13
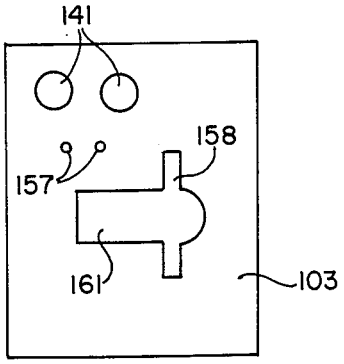
FIG. 14

FIG. 15
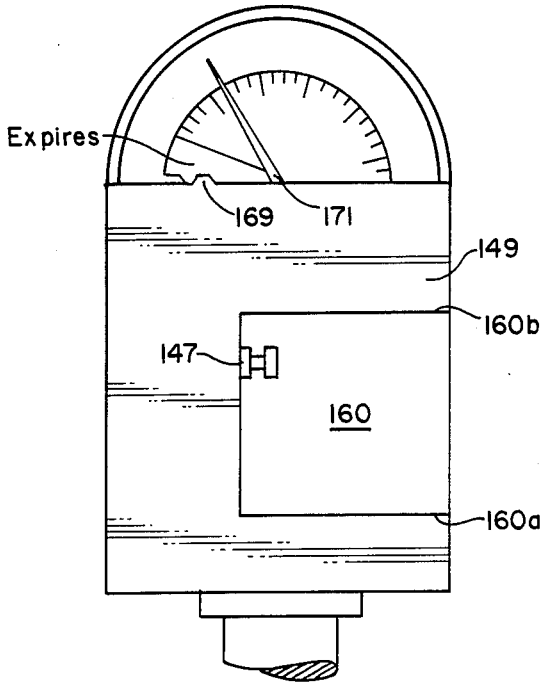
FIG. 16
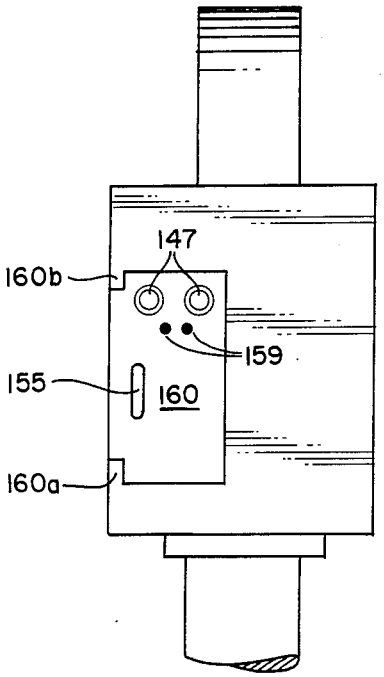
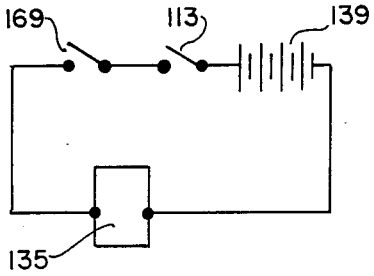
FIG. 17

AUTOMATIC COIN FEEDER WITH WINDING MECHANISM

In a typical parking meter construction, a mechanical clock mechanism is often employed. The mechanism is operated by means of a winding ring or the like with the number of coins inserted determining the degree of winding. The degree of winding, in turn, determines the amount of time indicated on the meter. The clock mechanism then automatically operates in a manner such that the indicator moves over the dial face to continually display the amount of time remaining.

It would be to the advantage of the user to have a device which when placed in combination with such a time oriented machine, could automatically feed coins to the machine in response to a signal indicating its need for another coin. If such a device were available for example, the need to go back to the parking lot to feed another coin to the machine before the time expired would be avoided since the device would automatically accomplish this act.

Devices for automatically feeding coins to apparatus are known. However, generally speaking, the prior art coin feeding devices are either complex, or are so simple as to eliminate such desirable characteristics as being able to sense when the coins are empty from the machine, are not readily insertable into the coin receiving device, thus making them susceptible to vandalism and the like, or are rather expensive to manufacture.

It is therefore apparent from the above, that there exists a need in the art for a simple, easily installable, relatively inexpensive device which can meet the above needs in the art. It is the purpose of this invention to fulfill this and other needs which will become apparent to the skilled artisan.

SUMMARY OF THE INVENTION

This invention relates to a device that may be clamped to a parking meter and which will automatically feed a coin to the parking meter just before the meter would, in absence of the coin, issue a "violation" signal.

The device has a stack of coins, and an automatic feeding device for pressing the coin at one end of the stack into the meter in response to a signal. The signal is given when the time-indication pointer of the meter is about to reach the "violation" point.

The device repeats the above sequence of events each time the pointer of the parking meter approaches the "violation" point, until all coins in the device are inserted into the parking machine. When all of the coins are exhausted, the device will no longer function to prevent the pointer of the parking meter from moving to the "violation" position.

BRIEF DESCRIPTION OF THE DRAWINGS

The accompanying drawings in conjunction with the description will make the invention more readily understood.

FIG. 11 is a side plan partially sectionalized view of an embodiment of this invention.

FIG. 12 is a top plan partially sectionalized view of the working mechanism of the embodiment of FIG. 1.

FIG. 13 is a partially fractured rear plan view of a locking mechanism as contemplated by this invention.

FIG. 14 is a front plan view of a front plate member of an embodiment of this invention.

FIG. 15 is a front plan view of a parking meter adapted to retain the embodiment of FIG. 11.

FIG. 16 is a side plan view of the parking meter of FIG. 15.

FIG. 17 is a schematic circuit diagram of the electronic circuitry as contemplated by this invention.

DESCRIPTION OF THE PREFERRED EMBODIMENT

Figure 1:
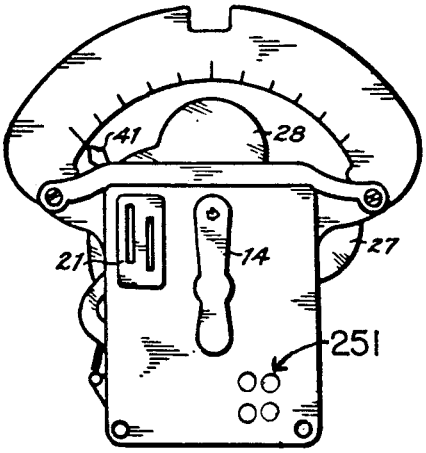
PRIOR ART FIG. 1
FIG. 1 is a front elevation view of a prior art Duncan parking meter as it appears when removed from its case.

The invention will now be described by way of a device to be operated in combination with the parking meter as the coin-receiving machine. While this is one of the preferred uses for the subject inventive concept, it is to be understood that generically the inventive concept covers many other coin feeding devices apparent from the following description.

The embodiment of the invention shown in FIGS. 11 to 17 incl., is for use with parking meters of the well known type wherein insertion of a coin winds the parking meter without further manual operations. In contrast, the other figures relate to an embodiment of the invention for use with parking meters of the type where it is not only necessary to insert a coin but to also turn a handle in order to wind the parking meter.

Referring to FIG. 11, there is provided a container 101 for housing the operative mechanisms of the device. Container 101 includes sidewalls 102 and front plate member 103. Connected by its front surface to the inner surface of front plate member 103 is coin receptable means 105 which houses a plurality of coins 107 and which by a mechanism, hereinafter discussed, is capable of positioning a single coin in feeding position.

Adjacent receptacle 105 is a sensing means receptacle 109 (FIG. 12) which houses retaining plate 111 and switch sensing means 113. Switch sensing means 113 is comprised of a switch mechanism 115 retained on the back surface of plate 111 and sensor 117 which contacts the coin 107 being retained in dispensing position.

Retained behind receptacles 105 and 109, is a coin feeding mechanism 119 comprised of housing 121, coin pusher plate 123, a pair of compression coil springs 125, and a back retainer plate 127. Coin pusher plate 123 is comprised of a longitudinally extending relatively thin vertical plate 129 bifurcated at its forward end, and having provided on either side, at its rearward end, guide bars 131. Guide bars 131 are positioned in sliding relationship within longitudinally extending groove 133 of housing 121. Compression coil springs 125 are positioned between the back surface of walls 105 and the forward surface of guide bars 131 so as to normally bias coin pusher plate 123 out of contact with coin 107.

As can be seen from FIGS. 11–12, back retainer plates 127 have between them a space aligned with the rearward portion of coin pusher plate 123, such that a solenoid arm actuated mechanism 135, of any conventional design, may have its armature 137 positioned so as to push forward, into coin contacting and dispensing relationship, coin pusher plate 123.

In this respect, of course, it is understood that any type of rotary solenoid or the like may be employed. A typical example is one that is capable of rotating about 45° to exert the necessary force and distance in order to push coin 107 into the parking meter as shown in FIGS. 15–16.

Also located within container 101 are batteries 139 for operating the electronic circuitry and solenoid 135 (FIG. 17). Generally speaking, these batteries may be of any conventional type, usually combined, amounting to 6 or 12 volts DC.

In order to position the device into coin dispensing relationship with, for example, the parking meter shown in FIG. 15, there are provided two mechanisms in front plate members 103. The first is a locking mechanism generally best illustrated in FIG. 13 wherein there are provided two holes 141 and a swing bar 143 which is biased at one end by coil spring 145. Male locking members 147 are provided within the internal wall of parking meter to prevent dislodgement thereof by way of vandalism or the like. This is accomplished by male locking members 147 extending through holes 141 and turning key 151 so as to rotate cam member 153 out of engagement with the end of swing bar 143. In such an instance, coil spring 145 biases swing bar 143 into locking engagement with male locking members 147. By rotating key 151 thereby bringing cam member 153 into engagement with 143 and in turn, cam member 153 into engagement with the end of swing bar 143 thereby raising it out of locking engagement with male members locking members 147, a convenient removal and locking mechanism is provided.

The second mechanism is provided to insure appropriate accurate alignment of the feeding mechanism with coin insertion orifice 155 of parking meter 149. In this respect, there is provided in the front surface of front plate member 103, a pair of male member pins 157 which are caused to align with female receptacle pin retaining means 159 in the internal surface of the housing of parking meter 149 as illustrated in FIG. 16. These pins can also serve as the electronic circuitry contact for a switch located in the meter, as hereinafter more fully explained.

One important feature of the preferred embodiments of this invention is that the dispensing mechanism and its housing may in its substantial entirety be retained within the housing of the parking meter. This is accomplished in FIGS. 15 and 16 by making receptacle 160 of slightly greater size than housing 101. This, coupled with receptacle flanges **160*a* and 160*b* provide a strong environment for housing 101, which limits access to pins 147 and thus inhibits theft. In addition, retaining housing 101 within receptacle 160** prevents accidental or intentional striking of the feeding device that houses the coins to be dispensed.

As best illustrated in FIG. 14, front plate member 103 is provided with a coin dispensing slot 158 and a horizontal, substantially larger slot 161 sufficiently large to enable coins to be reinserted in the device, when the device is partially or fully emptied. The coin dispensing and retaining mechanism found in receptacle 105 generally comprises a compression coil spring 163 and a coin retaining plate 165. Coin retaining plate 165, in turn, is provided with a concentrically oriented orifice 167 sufficiently large so as to allow sensor 117 to extend therewithin without contact when no coins are presented forward of coin retaining plate 165.

In order to actuate the coin dispensing mechanism, and with reference to FIG. 15, there is conveniently provided in parking meter 149 a switch mechanism 169 responsive to the operation of the meter. Switch 169 can be positioned in any convenient location either in the meter housing itself, or extending upwardly into the meter area (as illustrated) such that, when needle 171 of meter 149 indicates that time has expired, switch 169 is activated and sends a signal via appropriate circuitry through male pin members 157 to solenoid 135, thus starting the coin dispensing operation.

In other embodiments, it is not necessary that the signal generating mechanism be presented in the meter itself. Rather, a timing device could be presented within the container 101 rather than having a switch 169 in the meter to generate an actuating signal at a predetermined time.

With reference to FIG. 17, there is provided within the circuitry two switches which must be closed in order for the dispensing operation to take place. The first switch 169 located either in the timing device described above, or as shown in FIG. 15, in the meter itself. The second is switch 113 located in receptacle 109. Connected to these switches are battery means 139 and solenoid 135. Upon closing of both switches, and only when both switches are closed, does the device operate to dispense a coin.

This device is operated in the following manner: the appropriate number of coins is loaded into receptacle 105 via lot 161 by retracting plate 165 against compression spring 163. Upon release, spring 163 uncoils forcing the first coin into alignment with coin dispensing slot 158 and into alignment with vertical slot 173 housing coin pushing plate 123 extending through the rearward wall of receptacles 105 and 109. This also causes the first coin to contact sensor 117 and close switch 115.

Key 151 is then turned until cam member 153 contacts the lower surface of swing bar 143 opening holes 141. The device is then inserted into receptacle 160 in meter 149 using aligning male pins 157 inserted within female receiving orifices 159 and until male members 147 extend through receiving orifices 141. At this time, key 151 is rotated to eliminate contact between the lower surface of swing bar 143 and cam 153, thus causing coil spring 145 to bias swing bar 143 into locking engagement. Key 151 is removed, and the device is ready for dispensing a coin in response to signals from meter 149.

In the event that there is time still left on the meter, switch 169 is in open condition, and no activation, and therefore no feeding of a coin will take place. Since sensing switch 113, 115 is closed by way of coin 107 contacting sensor 117, when needle 171 finally contacts switch 169, thereby closing it, (i.e. when time expires)

then a coin will be dispensed into the device. (Of course, if time had already expired, the coin would be dispensed immediately upon insertion into receptacle 160.)

Dispensing is accomplished by switch 169 activating solenoid 135, which causes armature 137 to rotate pushing forward coin pushing plate 123. In turn, the bifurcated end of coin pushing plate contacts coin 107, pushing it forward and into orifice 155, thereby feeding the coin to the meter 149. This causes the meter 149 to raise needle 171 to the indicated time paid for. Once needle 171 comes out of contact with switch 169, switch 169 is opened, thus deactivating solenoid 135 and allowing compressed coil spring 125 to return plate member 123 to its open or non-coin-engaging position. Rear plates 127 provide a stop mechanism for this return.

Upon return of plate 123, compressed coil spring 163 pushes forward the next coin 107 into coin dispensing alignment with coin dispensing slot 158. As needle 171 once again contacts switch 169, when time is expired, another coin will automatically be dispensed until no further coins remain in the device.

When the device is out of coins, sensor 117 will extend through, without contact, orifice 167 in plate 165, thus maintaining switch 113, in open condition. This prevents any further dispensing operation from taking place when the device is out of coins. An appropriate light or other signaling mechanism can be provided in housing container 101 to indicate when switch 113, 115 is open, thereby indicating that no coins remain in the device.

The device is easily removed for refill by rotating key 151 as explained hereinabove and removing the device from its contained receptacle in meter 149.

Since a second embodiment of this invention is shown and described as a device attached to a particular Duncan parking meter, the details of a typical Duncan parking meter are desirable for a full understanding of this particular embodiment of the invention. Therefore, we have incorporated herein sufficient drawings and written descriptions from U.S. Pat. No. 2,603,288 entitled Coin-Controlled Timing Apparatus, to Lester D. Sollenberger, dated July 15, 1952, to enable a specific parking meter, to which our invention may be added, to be understood.

Accordingly, FIGS. 1 to 10 of this application are taken directly from said Sollenberger U.S. Pat. No. 2,603,288, except that clutch 201, electromagnet 203, wires 211, 213, connecting rod 231, square shaft 245, switches S1 and S2, and sockets 251, have been added.

Moreover, in connection with this second embodiment of the invention it should be understood that the coin feeding mechanism of FIGS. 11 to 14 is employed; that is the mechanism of FIGS. 11 and 12 is mounted directly on the parking meter of FIG. 1 so that the apparatus in casing 101 feeds coin 107 into slot 21 (FIG. 1) when switch S1 is closed, due to operation of time-expired flag 28 to its "violation" position.

Figure 19:
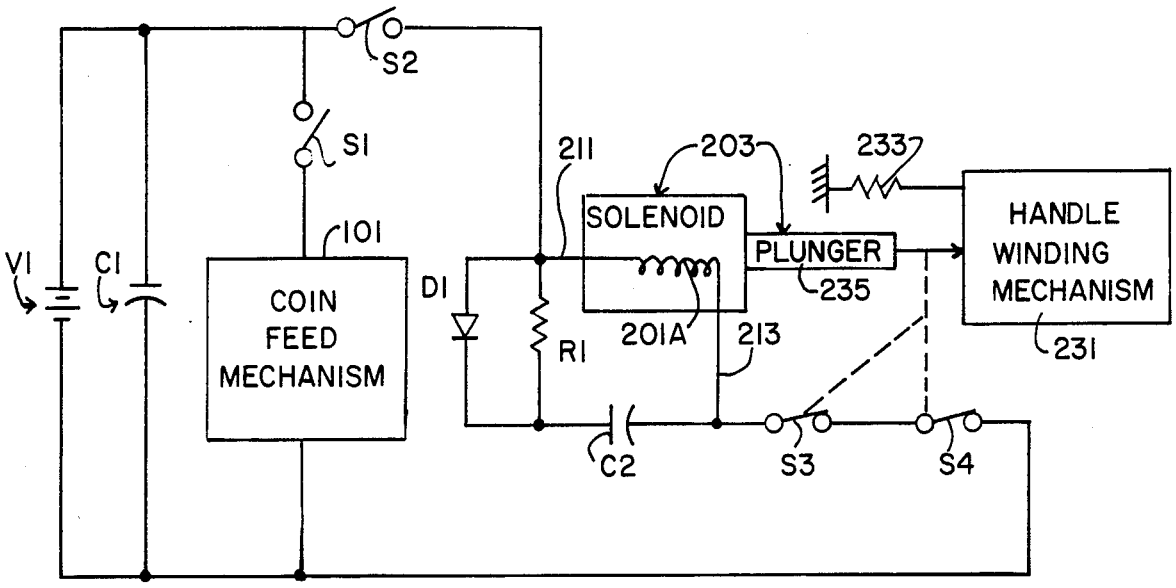
FIG. 19 is the circuit diagram for winding the time-spring shaft of the parking meter.

In this connection the casing 101 (FIG. 11), would, in this second embodiment of the invention, include in it the clutch 201, connecting rod 231, spring 233, electromagnet 203 (including plunger 235), wires 211 and 213, the circuit of FIG. 19 (except for switches S1 and S2), and a suitable square shaft 245 that fits in square hole 246 in the meter handle 14.

Before discussing the operation of our coin feeding mechanism for the Duncan parking meter, we will first explain how the Duncan meter operates without our invention. We do this by quoting from said Sollenberger U.S. Pat. No. 2,603,288 under the heading "Operation" as follows:

"In describing the operation of my invention, I shall first assume that it has been allowed to "run down"—that is, that the previous user has exhausted the parking time for which he paid and that the newly arrived motorist finds the meter showing zero time.

"Under those conditions, the meter will have the external appearance indicated in FIG. 1, needle 41 indicating zero time and expired-time flag 28 being up.

Figure 2:
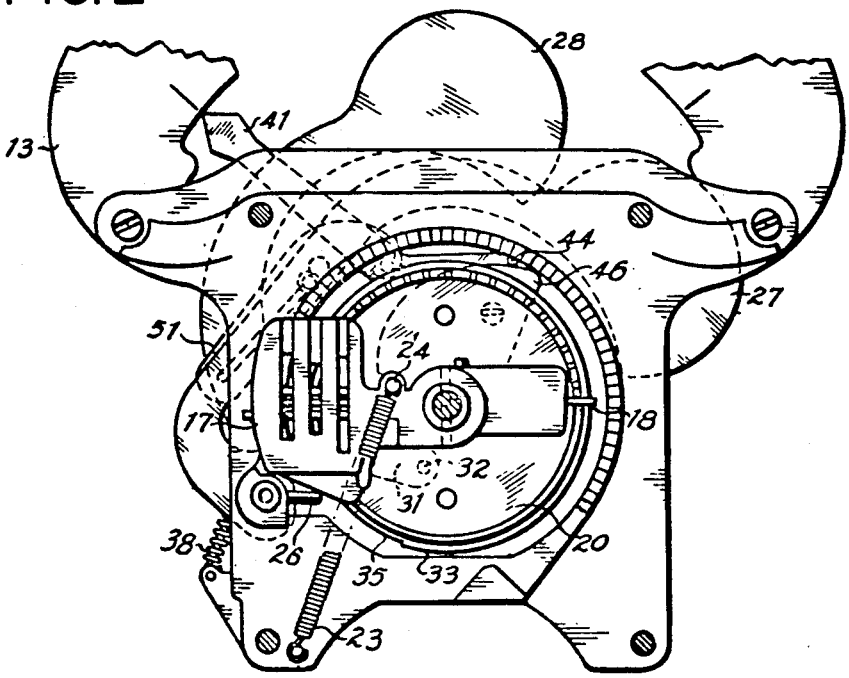
PRIOR ART FIG. 2
FIG. 2 is a front view, partly in section, of the Duncan meter.

"FIG. 2 shows in greater detail the position of the parts under those conditions. Control wheel 35 will be at its zero time position, whereat follower 32 will have overrun the edge of cam surface 33. Under those conditions, spring 30 will have pulled flag 28 upward into view as shown in FIG. 1. Flag 27 will of course be down, since coin carrier 17 will be resting on lever 26, and powerful spring 23 will force flag 27 into retracted position despite the counter-force of spring 38. When the motorist deposits a coin into slot 21, it will drop into the appropriate slot in coin carrier 17. The motorist will then grasp handle 14 and rotate it in a clockwise direction. As soon as coin carrier 17 moves off of lever 26, spring 38 will cause flag 27 to rise, and simultaneously therewith surface 37 will engage surface 36 and force flag 28 down. When that occurs, follower 32 is immediately moved outward to a point beyond the rim of control wheel 35, so that when flag 28 is released following clockwise rotation of wheel 35, follower 32 will press upon cam surface 33, which will then hold flag 28 down in retracted position so long as unexpired time remains on the meter.

"As clockwise movement of the handle continues, coin carrier 17 will "pick up" winding wheel 20 at a predetermined point, depending on the denomination of the coin inserted, and will thereupon carry with it winding wheel 20, control wheel 35, and cam 46 through the remainder of the cycle of clockwise rotation. (The details of the structure by which coin carrier 17 actuates winding wheel 20 are, as heretofore noted, fully disclosed in U.S. Pat. No. 1,799,056.)

"When the meter was in "time-expired" position, indicator 41 was, it will be understood, held in zero-time position by the pressure of cam 46 against the follower 44. (See FIG. 2.) As handle 14 is rotated by the motorist, cam 46 is moved in a clockwise direction through a predetermined arc, depending upon the denomination of the coin inserted, and as a result is moved out of engagement with follower 44. So long as handle 14 is away from its normal position of rest, however, indicator 41 will remain at zero-time position despite the movement of cam 46, however, because flag 27 will be up and link 51 will under those conditions hold indicator 41 against movement.

"Should the motorist fail to rotate handle 14 through its full cycle, the meter will show zero time and will also display red flag 27.

"When the handle 14 has been rotated to the limit of its clockwise movement, the coin will drop from the coin carrier into the coin receptacle (not shown) and handle 14 will thereupon be free to return to its rest position as soon as it is released by the motorist. When the handle has thus returned to its normal position, as shown in FIG. 1, coin carrier 17 will rest upon lever 26 and force flag 27 back to its retracted position. Lowering of flag 27 will release indicator 41, since pin 54 will ride up slot 53. Spring 42 will then cause indicator 41 to move clockwise until follower 44 comes into engagement with cam 46. The number of minutes indicated by needle 41 under those conditions will depend, of course, on the magnitude of the arc through which cam 46 has moved, and that arc, in turn, will depend on the denomination of the coin inserted.

"Clockwork 56 will thereupon cause counterclockwise rotation of shaft 55 and control wheel 35. Wheel 35, by means of pin 33*a*, will carry cam 46 with it as it turns. As time passes cam 46 will force indicator 41 steadily to the left until, when the number of minutes purchased has elapsed, the needle will be forced back to zero. The relative positions of control wheel 35 and cam 46 are such that shortly after needle 41 has returned to zero cam surface 33 will move beyond follower 32, leaving spring 30 free to pull expired-time flag 28 upward into the position shown in FIGS. 1 and 2.

Figure 5:
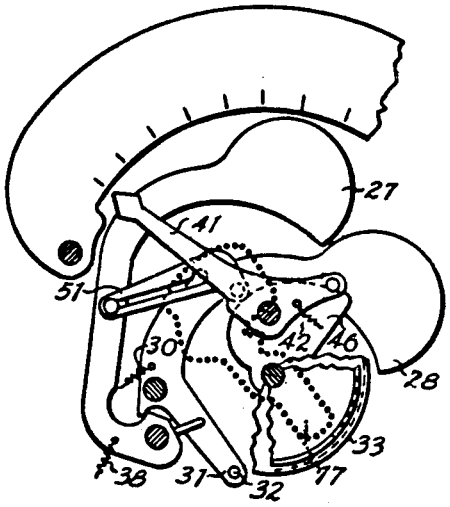
PRIOR ART FIG. 5
FIG. 5 through FIG. 10 are views similar to FIG. 4 of the Duncan meter exposing parts in their operative positions when the indicator is at different positions during the cycle of rotation.
Figure 6:
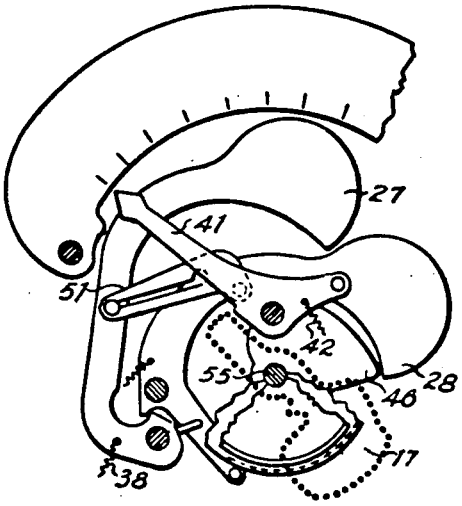
PRIOR ART FIG. 6
Figure 7:
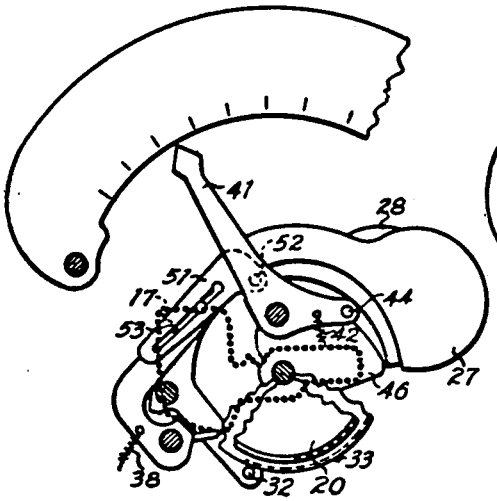
PRIOR ART FIG. 7

"The operation just described is shown in some detail in FIGS. 5–7 inclusive. FIG. 5 shows the parts in the position they occupy when coin carrier 17 has just started on its cycle of movement; FIG. 6 shows the position of the parts as coin carrier 17 has neared the extreme limit of its movement; and FIG. 7 shows the position of the parts after coin carrier 17 has completed its cycle and has been allowed to return to its rest position. It will be noted from FIG. 7 that indicator 41 has moved to the right from its zero position and indicates unexpired time.

Figure 8:
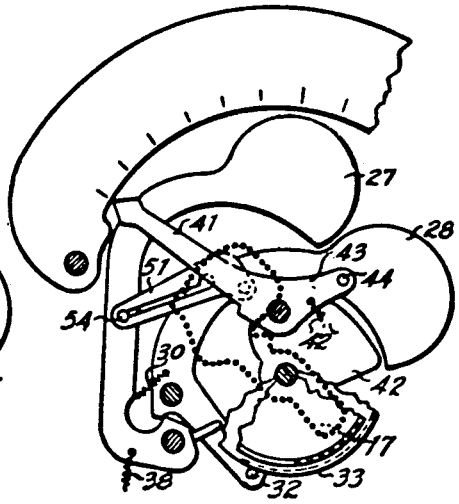
PRIOR ART FIG. 8
Figure 9:
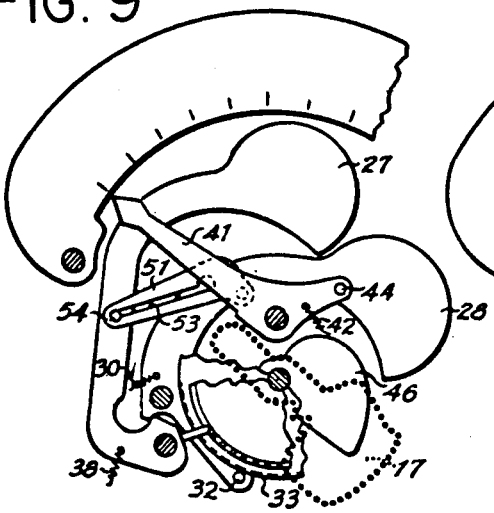
PRIOR ART FIG. 9
Figure 10:
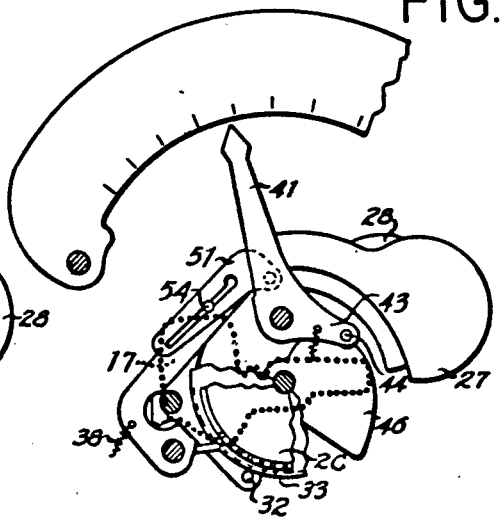
PRIOR ART FIG. 10

"FIGS. 8–10 show the behavior of the apparatus when a coin is placed in the meter to purchase additional time when unexpired time still remains on the meter. FIG. 7 illustrates the starting condition-both flags down and unexpired time showing. When a coin is deposited and movement of handle 14 commenced, trouble flag 27 rises and indicator 41 immediately returns to zero. This condition is shown in FIG. 8. The zero indication by needle 41 continues until the full cycle of movement of the coin carrier 17 has been completed. FIG. 9 shows the position of the parts just before coin carrier 17 is allowed to return to its rest position. Rotation of coin carrier 17 through its entire cycle will, of course, have rotated winding wheel 20, control wheel 35, and cam 46 through a predetermined arc in the clockwise direction, the amount of arc depending on the denomination of the coin used. When coin carrier 17 has returned to its rest position, as shown in FIG. 10, needle 41 will immediately move to the right under the impetus of spring 42 and will show the original time plus as many additional minutes as have been purchased by the newly inserted coin, since cam 46 will have been rotated clockwise from its former position by the number of additional degrees consistent with the denomination of the coin.

"The significant point, from the standpoint of the present invention, is that throughout the adjustment process the indicator 41 showed zero time, notwithstanding the fact that the meter actually had unexpired time "stored" in the position of cam 46."

The clutch 201 may be of any suitable type that will, in response to clockwise movement of connecting rod 231, rotate handle 14 and thereby drive the conventional clockwork mechanism 56 to wind the same in response to energization of electromagnet 203. The connecting rod 231 of clutch 201, however, is disconnected from handle 14 and from clockwise mechanism 56 after the clockwork mechanism 56 is fully wound, and spring 233 returns the clutch 201 and electromagnet 203 to their normal off position.

Clutches, such as just described, that will drive a mechanism in one angular direction, yet disconnect the driving source from the load, in the opposite angular direction, are old and well known. Such a clutch is shown and described in U.S. Pat. No. 4,297,924. An adaptation of that clutch to the present invention is shown in FIG. 3.

Figure 3:
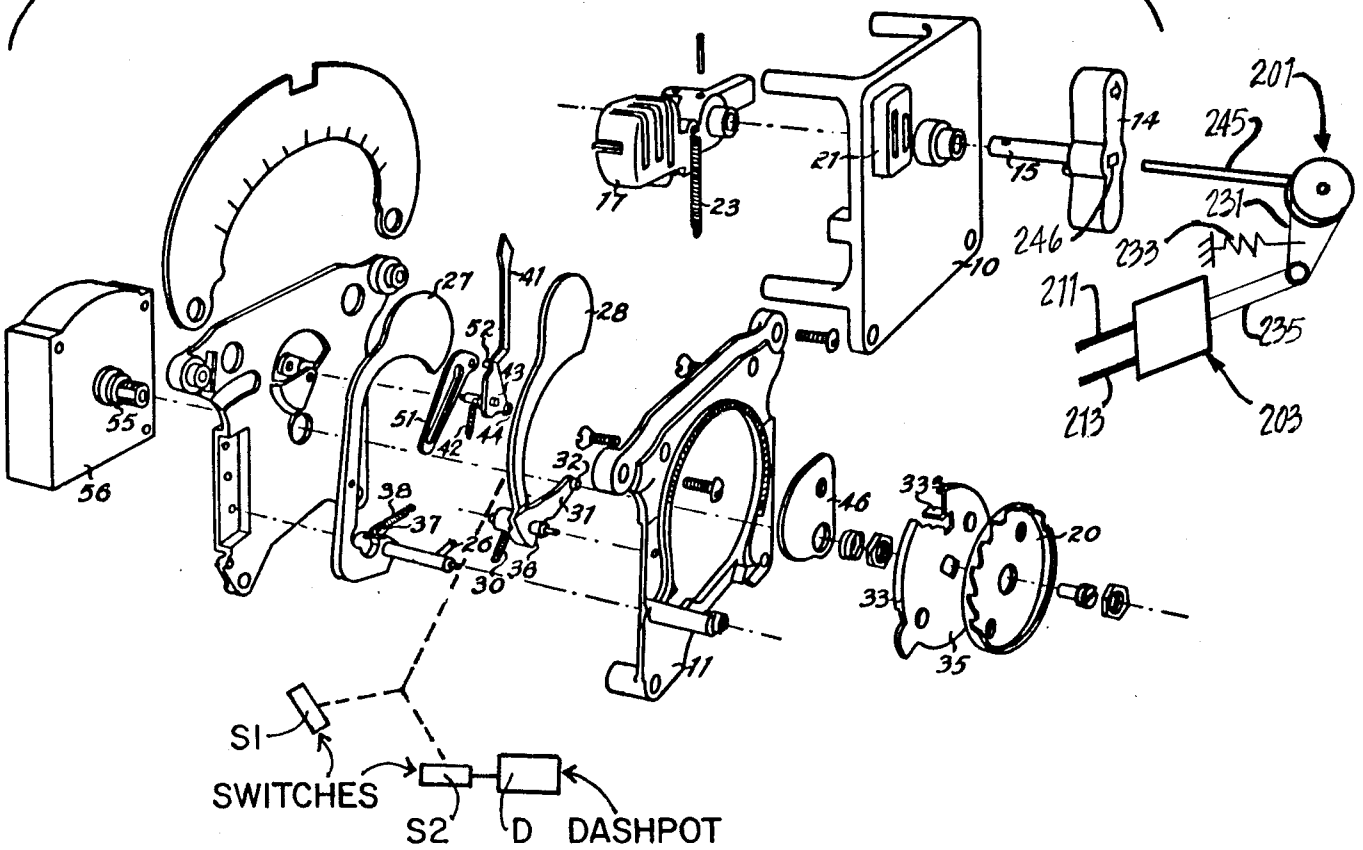
FIG. 3 is an exploded perspective view with one-directional clutch means for winding up the Duncan meter.
Figure 4:
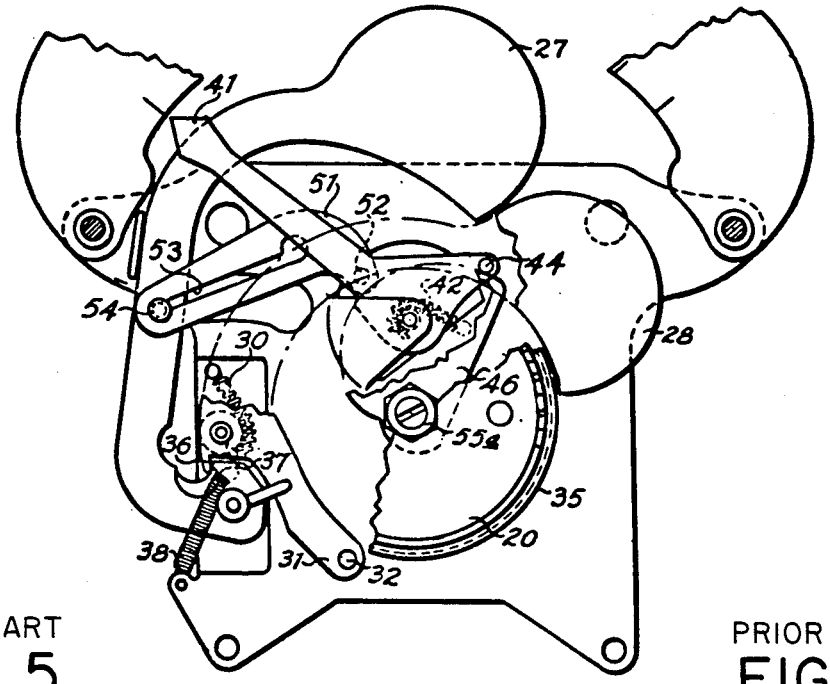
PRIOR ART FIG. 4
FIG. 4 is a fragmentary view of certain moving parts of the Duncan meter.
Figure 18:
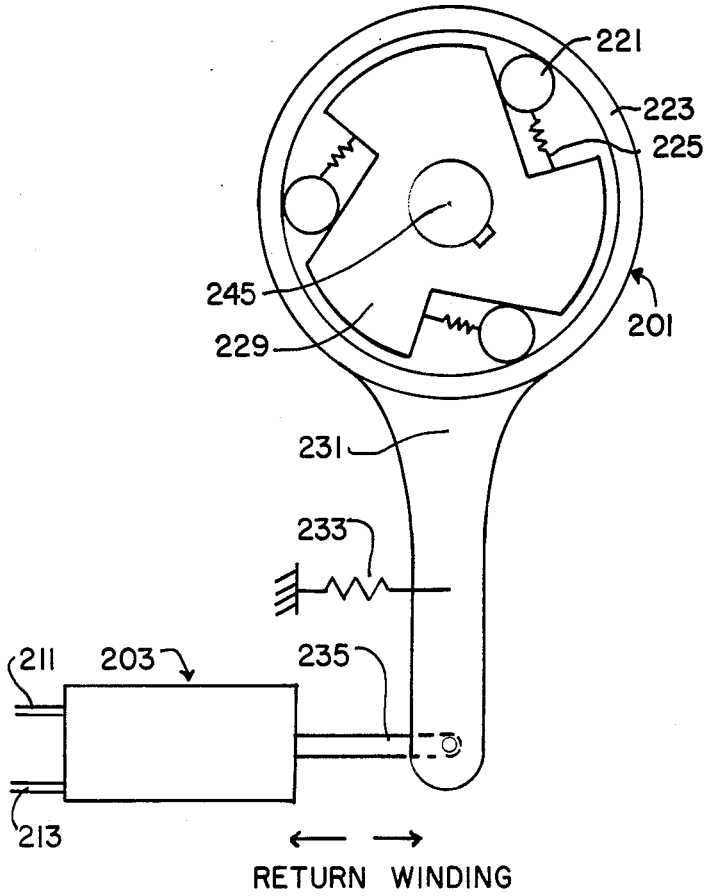
FIG. 18 is the exposed view of the one-directional clutch means for winding the meter shaft.

As shown in FIGS. 3 and 18, the one-directional clutch 201 for winding the meter knob 14 which in turn winds clockwork 56, comprises a connecting rod 231 with its large end in the form of a circular rim 223 which is connected to the square shaft 245 through steel balls 221 supported by compressed springs 225 anchored to a fly wheel 229 mechanically connected to square shaft 245.

When the plunger 235 is activated by the counterclockwise turning of the rod 231 the friction between the circular rim 223 and the balls 221 causes the fly wheel 229 to be turned with the balls 221, thus winding the meter knob 14. The return stroke of the plunger 235 does not exert a torque on the square shaft 245 because the balls 221 compress the springs toward their anchorages on the flywheel 229 eliminating the friction between the balls 221 and the circular rim 223.

Prior to circuit activation by parking meter time expiration, switches S1 through S4 have their contacts in the states shown in FIG. 19 and the battery has charged capacitor C1 to 12 volts. The purpose of capacitor C1 is to provide a high current to the solenoid 203 for full activation overcoming the current limitation imposed by the internal resistance of the batteries V1.

The circuit is activated by switches S1 and S2 being closed mechanically by the parking meter. The closure of switches S1 and S2 could be performed by any part of the parking meter which moves as the time is approaching expiration, for example, pointer 41 or time-expired flag 28. In the example shown switches S1 and S2 are actuated when the time-expired flag 28 moves to its "violation" position. Closure of switch S1 activates the coin feed mechanism (FIGS. 11 and 12) which feeds a coin from the reservoir 105 into the parking meter. Switch S2 is a delay action switch which delays closing its circuit for one or two seconds after it is actuated by movement of flag 28 to its "violation" position. When switch S2 is closed, one or two seconds after switch S1 is closed, it applies 12 volts from the battery V1, and capacitor C2 is charged from capacitor C1, to 11 volts through the diode D1, and the solenoid 201A of electromagnet 203 is energized. Upon energization of solenoid 201A its plunger 235 activates the handle-winding rod 231 of the parking meter and advances it an increment where it is held mechanically. The motion of plunger 235 opens switch S3 as the plunger 235 first begins to move and then opens switch S4 at the end of its travel. With switch S3 open, the 12-volt battery circuit is removed from activation of the solenoid 203, but the charge stored on capacitor C2 keeps the solenoid 201A energized for 0.1 seconds (set by the choice of register R1 and capacitor C2). After capacitor C2 discharges, the solenoid plunger 235 returns to its de-energized position and, in so doing, first closes switch S4 then closes switch S3. Capacitor C2 is then again charged and solenoid 201A again energized to operate the plunger 235 and wind the parking meter handle 14 another increment. The battery V1 recharges capacitor C2 during the interval required for switch S3 to close. This process is repeated until, after several increments, the meter is fully wound and the time-expired flag 28 moves away from the "violation" position and opens switches S1 and S2.

We will next discuss the "operation" of the second embodiment of the invention.

It is assumed that all of the parking meters in the parking lot have been modified as shown in FIG. 3. The driver of the car, parking next to the meter, then inserts a coin in the parking meter (FIG. 1), and then fills his coin dispensing apparatus (see FIGS. 11 and 12) with sufficient coins to cover the period for which he expects to park. He then locks casing 101 to the parking meter and removes the key 151.

When the time runs out, that was paid for with the manually inserted coin, the violation flag 28 will move to its "violation" position closing switch S1, and closing switch S2 a second or two later (FIG. 3). The delay of S2 is effectuated by the dashpot D. The battery V1 and capacitor C1 will now via switch S1 energize the rotary solenoid 135 and rotate arm 137 pressing coin 107 (FIG. 11) into slot 21 (FIG. 3). The meter will reset during the delay period of switch S2 which thereafter closes and thereby energizes electromagnet 203 which rotates connecting rod 231 and winds the handle 14, one increment, which in turn winds the clockwork mechanism 56, one increment, and thus resets the meter. The motion of plunger 235 opens switches S3 and S4 in sequence (FIG. 19), but the charge on capacitor C2 holds the solenoid 201A energized momentarily until the plunger 235 completes its power stroke. The electromagnet 203 is deenergized a moment later when switch S3 opens, and spring 233 returns the system to its normal de-energized state. When condenser C2 is recharged the solenoid 201A will be re-energized giving plunger another stroke. Thus, the plunger 235 will intermittently wind the parking meter clockwork 56 another increment until it is fully wound and flag 28 moved from its violation position.

When the time, paid for by the coin-automatically fed into the system expires, the "violation" flag 28 will again operate and the above recited process for automatically inserting a coin will be repeated.

Figure 20:
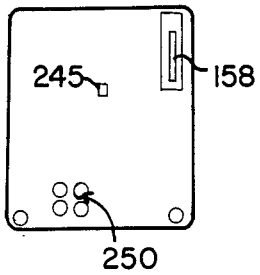
FIG. 20 is a front view of casing in FIG. 11 with mating means to align the coin feeder emitting slot 158 with parking meter receiving slot 21.

FIG. 20 is a front-view of casing 101 (FIG. 11) as modified to work with the second embodiment of the invention. The coin emitting slot 158 and the square shaft 246 are so spaced that they perfectly mate with coin receiving slot 21 and square hole 246, respectively, when the casing 101 is clamped on the parking meter. The four pins 250 (FIG. 20) mate with the four sockets 251 (FIG. 1) to enable switches S1 and S2, which are in the parking meter itself to be connected to the electrical circuit (FIG. 19) all of which is in casing 101 except for the two switches S1 and S2.

If the device runs out of coins the meter will allow the time to expire, and the red "violation" flag 28 will appear. Since no coin will be inserted, the coin carrier 17 cannot rotate and it is not possible to rotate flag 28 from its violation position.

Figure 21:
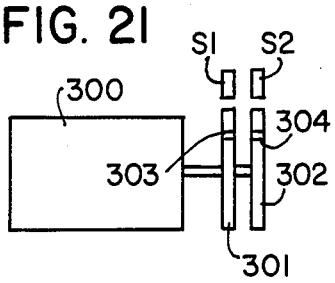
FIG. 21 is a block diagram showing clockwork with cams for the actuation of electrical switches in the circuit of FIG. 19.

Instead of switches S1 and S2 being closed when the parking meter approaches a "violation" condition, as previously explained, these switches could instead be operated periodically by a clockwork. For example, if the parking meter requires a new coin to be inserted once each hour to avoid a "violation" a clock, either electronic or one with a mainspring plus escapement, may be provided to close each of switches S1 and S2 in the required sequence and for a sufficient duration to cause the circuit of FIG. 19 to rewind the mainspring 56 (FIG. 3) of the parking meter. Since clock mechanisms for controlling switches are very well known in the prior art, our illustration of the modified form described in this paragraph is in block diagram form (see FIG. 21) wherein clockwork 300 operates cams 301 and 302 that respectively have raised surfaces 303 and 304 which respectively operate switches S1 and S2 at the desired periodic times and in the proper sequence.

We claim to have invented:

1. A device for sequentially feeding coins to a coin receiving machine in response to a signal,
   said device comprising means for retaining a plurality of coins in alignment for sequential dispensing,
   battery operated dispensing means for dispensing a single coin at a time from said device,
   battery means for energizing said battery operated dispensing means,
   means responsive to said signal or actuating said dispensing means,
   means for disconnecting said battery means from said battery operated dispensing means, and thereby prohibiting actuation of said dispensing means, when there are no coins present in said retaining means; and for allowing actuation of said dispensing means upon receipt of said signal when a coin is present in dispensing position, whereby said battery means would be subjected to an unnecessary current drain, when no coin is present to be dispensed, in the absence of said means for disconnecting said battery means from said battery operated dispensing means,
   means for positioning said device in coin dispensing alignment with said coin receiving machine, and
   locking means for securing said device to said coin receiving machine.

2. In the combination of claim 1:
   said dispensing means including an electrical circuit for actuating the same,
   said means for prohibiting actuation comprising means whereby when all of said coins have been dispensed the circuit is opened and the dispensing means is prohibited from actuation.

3. In combination:
   a parking meter having timing means to show that the time paid for has expired,
   said parking meter including a coin receiving opening, and
   coin feeding means for detachable connection to said parking meter,
   said coin feeding means including means responsive to said timing means for feeding a coin into said opening.

4. In the combination of claim 3,
   said timing means including indicating means for indicating whether the time paid for has expired,
   said coin feeding means being responsive to said indicating means, for feeding a coin into said parking meter.

5. In the combination of claim 3, including locking means, having a removable key, for locking the coin feeding means to said parking meter.

6. In the combination of claim 3:
   (a) said timing means having clockwork means that should be rewound after a coin is fed into said opening in order to prevent the parking meter from indicating that the time paid for has expired, and
   (b) means responsive to said timing means for rewinding said clockwork means after a coin has been fed into said opening.

7. The combination of claim 6, in which element (b) comprises an electrical circuit that rewinds said clockwork means in increments, said electrical circuit comprising:

a source of direct current, a capacitor, solenoid operated means for winding said clockwork in increments, and means for charging said capacitor from said source and then discharging said capacitor into said solenoid means to effect one increment of said winding, and then repeating said charging and discharging actions to provide a further increment of rewinding.

8. In the combination of claim 3:

said timing means having a clockwork and a manually operable knob for rewinding said clockwork, said coin feeding means including means, when the coin feeding means is attached to said parking meter, for operating said knob to rewind said clockwork after said coin feeding means has fed a coin into said opening.

9. In the combination of claim 3:

said coin feeding means having an electrical circuit for actuating the same, said circuit having first and second switches, said first switch being operated by said timing means and said second switch being responsive to the presence of a coin in said coin feeding means; so that said coin feeding means will feed a coin only in response to a predetermined condition of said timing means as well as the presence of a coin in said coin feeding means.

10. A parking meter as defined in claim 3, in which said timing means is a spring-wound clock whose spring unwinds as the time left on the parking means is expiring and is rewound to restart the clock, first and second switches controlled by said timing means, said first switch being operated after a predetermined elapsed time of said timing means, said coin feeding means comprising means responsive to said operation of said first switch for feeding a coin into said opening, delay means for said second switch to delay its operation until after said coin feeding means has fed a coin into said opening, and rewind means responsive to the aforesaid operation of said second switch to rewind said timing means.

11. In a parking meter as defined in claim 10 in which said rewind means includes movable means which moves back and forth intermittently when said second switch is operated, and a clutch that translates said intermittent back and forth has movement into a rotary motion in one angular direction for rewinding said clock.

12. A parking meter having a clockwork for controlling the same, automatic coin feeding means for feeding coins into said meter from time to time, winding means which winds said clockwork in increments after said automatic coin feeding means feeds a coin into said parking meter, and a casing detachable from said parking meter and containing both said winding means and said automatic coin feeding means.

13. A parking meter and coin feeding device as defined in claim 12 in which:

said winding means comprising a battery operated electrical device which intermittently produces a force large enough to wind said clockwork a small increment to thereby ultimately wind said clockwork.

14. A parking meter and coin feeding device as defined in claim 13 in which said battery operated electrical device comprises:

a battery, a capacitor across said battery to provide a higher current temporarily than the battery is capable of providing, a solenoid energized by said battery and capacitor, an armature moved by said solenoid from a first to a second position when the latter is energized, said first position being a normally off position, means operated by said solenoid for producing said intermittent force, means operated by said armature for deenergizing said solenoid after said armature is moved by said solenoid and for disconnecting said solenoid from said battery and said capacitor, and means for returning said solenoid to said off position and reconnecting said battery and capacitor to said solenoid, whereby said solenoid is intermittently energized to provide said intermittent force.

15. Apparatus as defined in claim 14 including a second capacitor across said solenoid to hold the solenoid energized temporarily after the source and first named capacitor are disconnected from the solenoid.

16. Apparatus as defined in claim 14 including clutch means for translating each movement of the armature from said first position to said second position and back to said first position into an incremental rotary motion in a single angular direction and means responsive to said incremental rotary motion for incrementally winding said clockwork.

17. A parking meter and a device for attachment to, and detachment from, the parking meter for controlling the parking meter comprising:

said parking meter having clock means for indicating when the parking time has expired, said clock means having a spring for driving the clock means and also having movable means which may be moved for winding said spring, said parking meter defining a coin receiving slot for receiving coins fed into said parking meter, and means permitting said spring to be wound by said movable means after a coin is fed into said slot, said device comprising a container including means for attaching the container to the outside of said parking meter and for detaching said container from said parking meter, a battery in said container, a coin receptacle in said container for storing a plurality of coins, means in said container and operated by said battery for feeding one of said coins into slot, and winding means carried by said container and operated by said battery immediately after a coin is fed into said slot for moving said movable means to wind said spring.

18. The apparatus of claim 17 including locking means carried by said container for locking said container to the outside of said parking meter.

19. The apparatus of claim 17 in which said movable means is a rotatable handle on the parking meter, said winding means comprising means in said container for converting power of said battery into an angular motion, said winding means having a member for engaging said handle to rotate it and thereby wind said spring.

* * * * *